US010916096B2

(12) United States Patent
Degens et al.

(10) Patent No.: US 10,916,096 B2
(45) Date of Patent: Feb. 9, 2021

(54) ELECTRONIC GAMING SYSTEM HAVING VISUAL CUE INDICIA WITH A SPECIAL SYMBOL CHARACTERISTIC

(71) Applicant: Aristocrat Technologies Australia Pty Limited, North Ryde (AU)

(72) Inventors: Erika Degens, Epping (AU); Dinh Toan Tran, Wetherill (AU); Oliver Crispino, Rosemeadow (AU); Marc Mayo, Bass Hill (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/517,142

(22) Filed: Jul. 19, 2019

(65) Prior Publication Data

US 2020/0051387 A1 Feb. 13, 2020

(30) Foreign Application Priority Data

Aug. 8, 2018 (AU) ..... 2018214060

(51) Int. Cl.
*G07F 17/32* (2006.01)

(52) U.S. Cl.
CPC ..... *G07F 17/3258* (2013.01); *G07F 17/3213* (2013.01)

(58) Field of Classification Search
CPC ..... G07F 17/32
See application file for complete search history.

(56) References Cited

U.S. PATENT DOCUMENTS 6,251,013 B1 * 6/2001 Bennett ..... G07F 17/3211 463/13
2001/0031659 A1 * 10/2001 Perrie ..... A63F 3/00643 463/18
2012/0088567 A1 * 4/2012 Aoki ..... G07F 17/34 463/20

* cited by examiner

*Primary Examiner* — Omkar A Deodhar
(74) *Attorney, Agent, or Firm* — McAndrews, Held & Malloy, Ltd.

(57) ABSTRACT

A gaming system is described that comprises a symbol selector that selects a defined number of symbols from a set of symbols for display in a symbol display area, the set of symbols including at least one special symbol. The system also includes an outcome determiner that determines whether a winning outcome is determined to exist based on the displayed symbols, and a prize allocator that awards a prize if a winning outcome is determined to exist. If a defined condition exists during the game, the system displays visual cue indicia associated with a special symbol at a defined display location. Prior to displaying the selected symbols, the system displays a succession of symbols at the defined display location and subsequently displays a selected symbol at the defined display location. A winning outcome is determined to exist if a special symbol is selected and displayed at the defined display location.

20 Claims, 8 Drawing Sheets

400

| | Reel position | Reel 1 (421) | Reel 2 (422) | Reel 3 (423) | Reel 4 (424) | Reel 5 (425) |
|---|---|---|---|---|---|---|
| 401 | 1 | Pic 1 | 10 | Pic 3 | Q | Pic 1 (430) |
| 402 | 2 | Wild | Q | Trigger symbol (436) | A | 10 |
| 403 | 3 | Trigger symbol (436) | K | 10 | 10 | A (430) |
| 404 | 4 | Q | A | Q | Pic 2 | Pic 2 |
| 405 | 5 | 10 | Pic 2 | K | J | A |
| 406 | 6 | A | 9 | Pic 1 | Wild (431) | Q |
| 407 | 7 | Trigger symbol (436) | Wild | J | 9 | K |
| 408 | 8 | A | Pic 3 | Trigger symbol (436) | 10 | Pic 2 |
| 409 | 9 | Q | Q | 9 | A | 9 |
| 410 | 10 | Trigger symbol (436) | 10 | Q | Q | Wild (436) |
| 411 | 11 | J | A | 10 | J | 9 |
| 412 | 12 | 10 | Wild | Wild | K | Q |
| 413 | 13 | Pic 3 | K | Trigger symbol (436) | Wild | 10 |
| 414 | 14 | Wild | J | A | Pic 3 | Wild (436) |
| 415 | 15 | 9 | 10 | Wild | Pic 1 | A |

443 442 441

FIG. 4

ELECTRONIC GAMING SYSTEM HAVING VISUAL CUE INDICIA WITH A SPECIAL SYMBOL CHARACTERISTIC

RELATED APPLICATIONS

The present application claims priority to Australian Patent Application No. AU 2018214060, filed Aug. 8, 2018, and entitled "A Gaming System" which is hereby incorporated by reference in its entirety.

FIELD

The present application relates to a gaming system and to a method of gaming.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

The described gaming system implements a game that provides a player with enhanced anticipation of a winning outcome by displaying visual cue indicia at a fixed location in a symbol display area, and awarding a prize, such as a jackpot prize, if a special symbol having a characteristic that is similar to the visual cue indicia is subsequently displayed at the same location as the visual cue indicia. The visual cue indicia has a characteristic that matches a characteristic of the special symbol, for example because the visual cue indicia has an outline that is the same shape as the special symbol or the visual cue indicia is a silhouette of the special symbol.

A gaming system is described that comprises a symbol selector arranged to select a defined number of symbols from a set of symbols for display in a symbol display area, the set of symbols including at least one special symbol. The system also includes an outcome determiner that determines whether a winning outcome is determined to exist based on the displayed symbols, and a prize allocator that awards a prize if a winning outcome is determined to exist. If a defined condition exists, the system displays visual cue indicia associated with a special symbol at a defined display location before a selected symbol is displayed at the defined display location. The visual cue indicia is representative of the special symbol. The system displays a succession of symbols at the defined display location before displaying a selected symbol at the defined display location. A winning outcome is determined to exist if a special symbol is selected and displayed at the defined display location.

A method of gaming is described that involves selecting a defined number of symbols from a set of symbols for display in a symbol display area. If a defined condition exists, visual cue indicia representative of the appearance of a special symbol is displayed at a defined display location before a selected symbol is displayed at the defined display location. The method involves displaying a succession of symbols at the defined display location before displaying a selected symbol at the defined display location. The method also includes determining that a winning outcome exists if a special symbol is selected and displayed at the defined display location, and awarding a prize if a winning outcome is determined to exist.

BRIEF DESCRIPTION OF DRAWINGS

An exemplary embodiment of the disclosure will now be described with reference to the accompanying drawings in which:

FIG. 4 illustrates an example reel strip layout.

DETAILED DESCRIPTION

Figure 1:
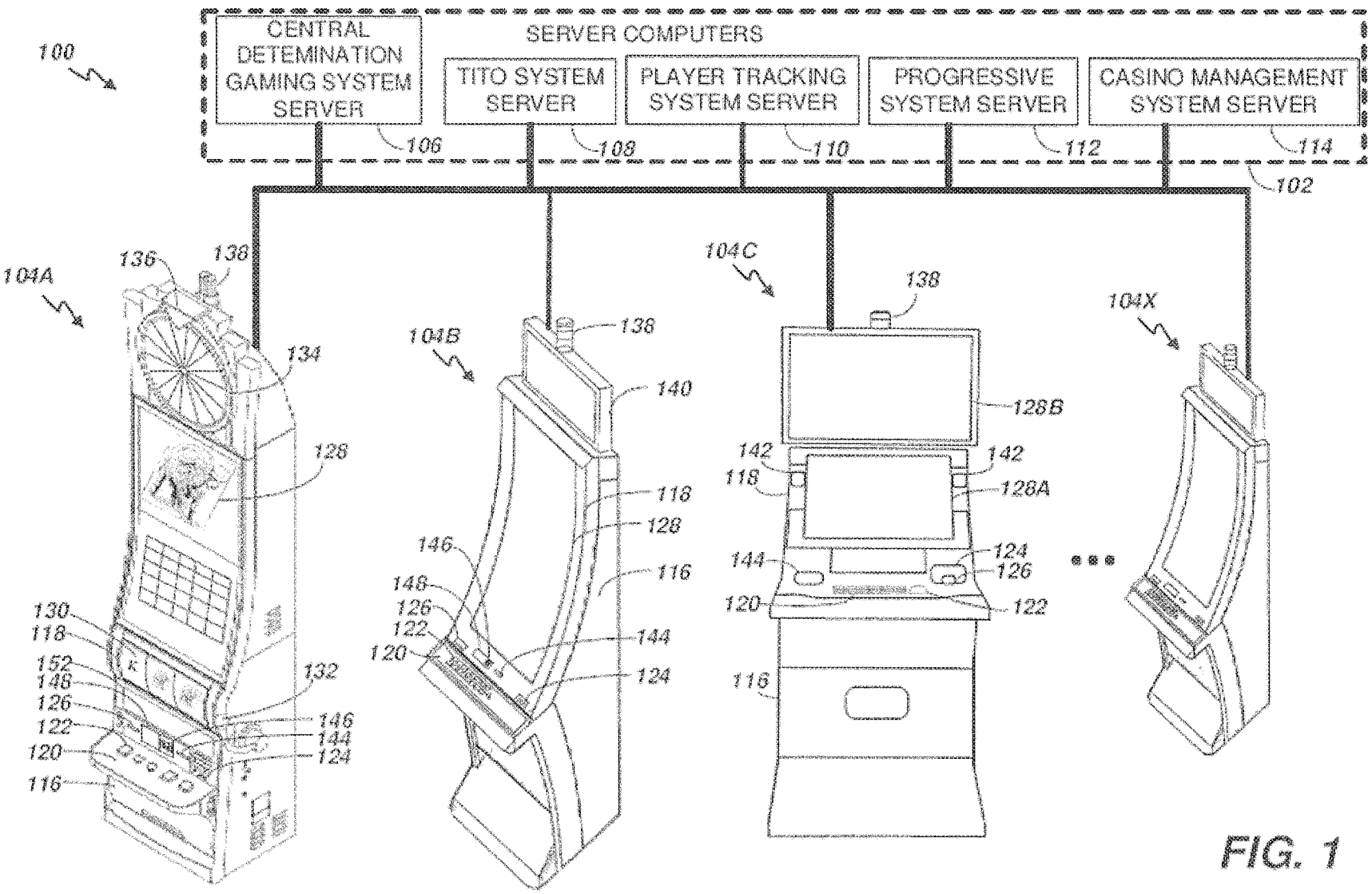
FIG. 1 is an exemplary diagram showing several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
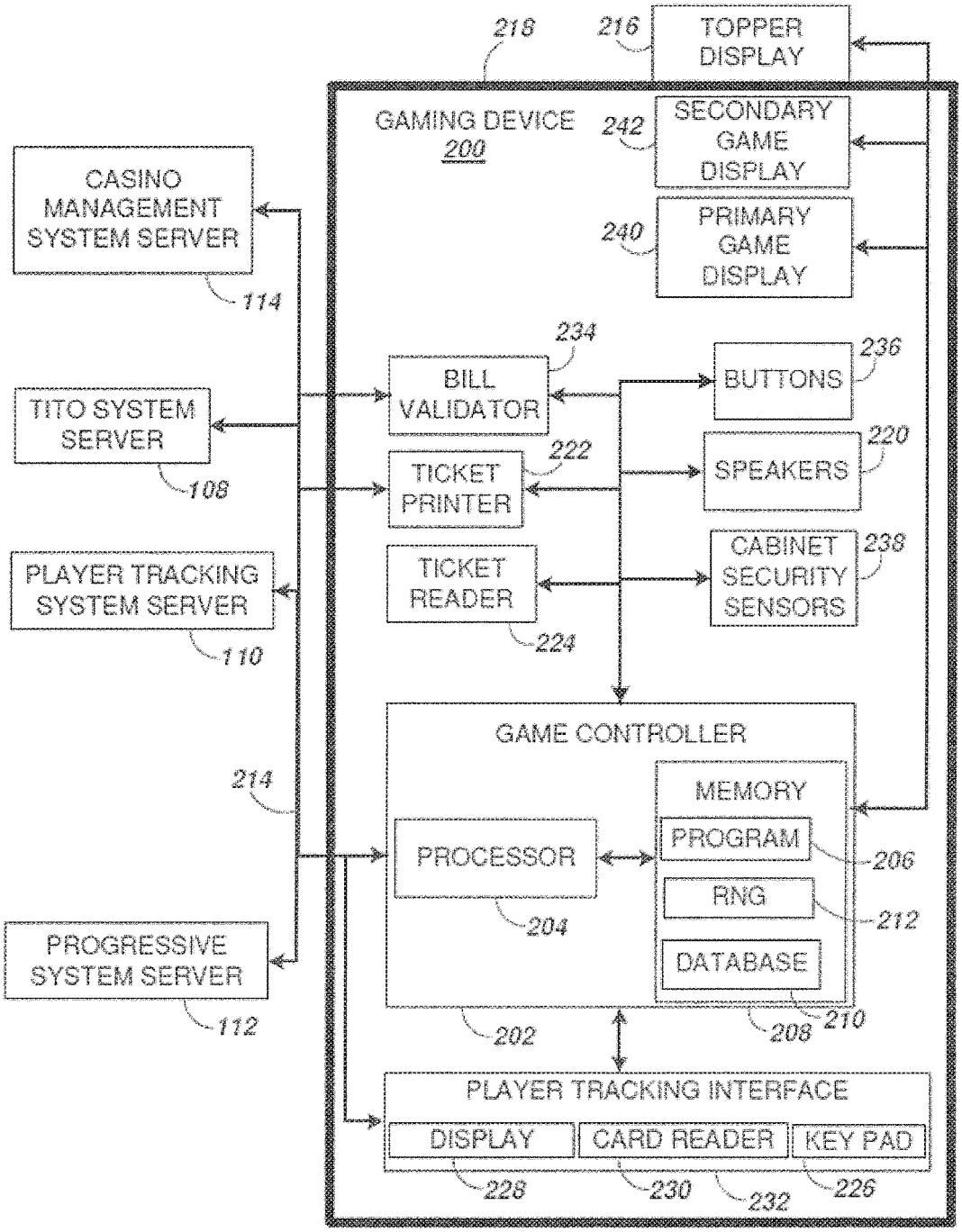
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3:
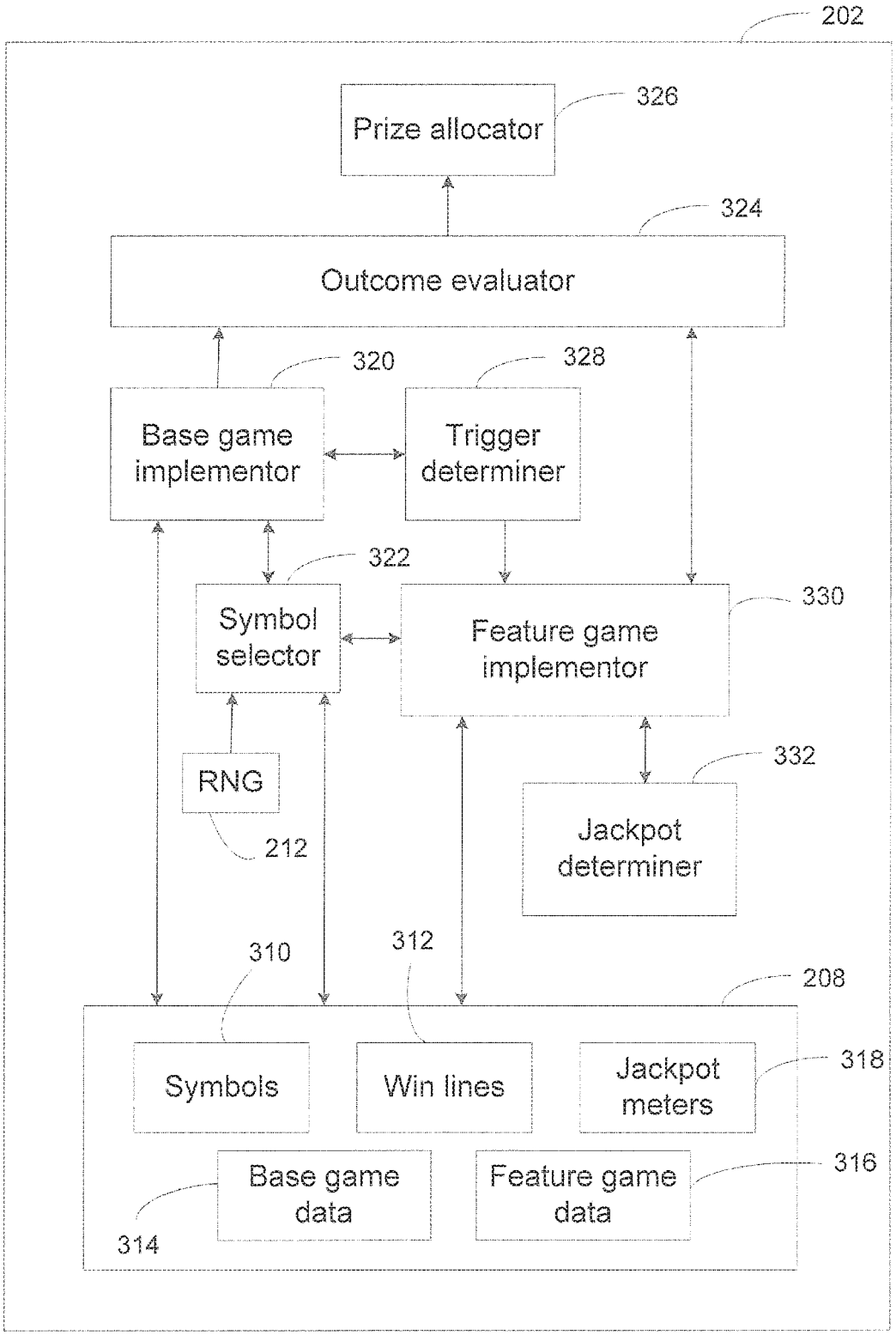
FIG. 3 is a block diagram showing functional components implemented by a game controller.

FIG. 3. Illustrates a block diagram showing functional components implemented by the game controller 202. In this example, the functional components comprise data stored in the memory 208, including data indicative of symbols 310, data indicative of win lines 312, base game data 314 that defines characteristics of a base game, and feature game data 316 that defines characteristics of a feature game.

In this example, the game controller 202 also manages multiple jackpot meters 318, in this example of progressive type wherein credits are progressively added to a jackpot amount, for example based on gaming machine turnover, and a jackpot is won based on occurrence of a jackpot trigger condition. In this example, "Grand", "Major" and "Minor" jackpots are available corresponding to jackpot amounts of progressively reducing size and progressively increasing likelihood of occurrence.

The functional components also include a base game implementer 320 arranged to implement a base game using the stored base game data 314, the base game implementer 320 using a symbol selector 322 to select symbols according to symbols data 310 for display at a plurality of display positions, for example using the random number generator 212. Outcomes of a base game are determined by an outcome evaluator 324 and any applicable prize is awarded by a prize allocator 326.

During implementation of a base game by the base game implementor 320, the outcome evaluator 324 determines whether a base game outcome corresponds to a winning outcome, and the prize allocator 326 awards a prize according to the winning outcome and for example based on a base game pay table.

The functional components also include a trigger condition determiner 328 arranged to make a determination based on the outcome of a base game as to whether to commence a feature game, in this example a jackpot feature game, for example based on whether a trigger condition has occurred during the base game such as selection and display of a defined combination of trigger symbols during the base game.

The functional components also include a feature game implementer 330, in this example arranged to implement a jackpot feature game using the stored feature game data 316 and for example the symbol selector 322 to select symbols for display at a plurality of display positions. Outcomes of a feature game are in this example also determined by the outcome evaluator 324 and any applicable prize is awarded by the prize allocator 326.

During a feature game, if a defined symbol is selected and displayed in a display area, for example in a defined symbol group such as a defined reel of a spinning reel type game, visual cue indicia is displayed in a defined symbol display position of another symbol group such as in a different defined reel. The visual cue indicia is stationary while symbols at the defined symbol display position change prior to symbol selection. If a special symbol is selected at the defined symbol display position that matches a characteristic of the visual cue indicia, a prize is awarded. In this example wherein the feature game is a jackpot feature, the prize may be a jackpot prize wherein a player is awarded credits based on an accumulating prize pool. In implementations wherein the feature game is not a jackpot feature, a prize such as a defined number of credits or free games, or any other game related bonuses may be awarded. In a jackpot example, the type of jackpot awarded (Grand, Major or Minor) may be determined randomly or according to defined criteria, for example based on the type of special symbol selected and displayed in the display position corresponding to the location of the visual cue indicia.

FIG. 4 illustrates an example of a set 400 of five reel strips 421, 422, 423, 424, 425 used during a base game. In the example, each reel strip has fifteen reel strip positions 401-415. Each reel strip position of each reel has a symbol 430. For example, a "Wild" symbol 431 occupies the sixth reel strip position 406 of the fourth reel 424. Other reels strips to those illustrated in FIG. 4 can be used, for example, reel strips where two or more wild symbols are placed at consecutive reel strip positions of a reel strip. In other examples, the reel strips could have between 30 and 100 reel strip positions. The actual length of the feature game reel strips would depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP).

The reel strips also include feature trigger symbols 436 that cause a feature to commence when selected and displayed, in this example when defined number of trigger symbols are displayed, such as 3 trigger symbols 436.

Figure 5:
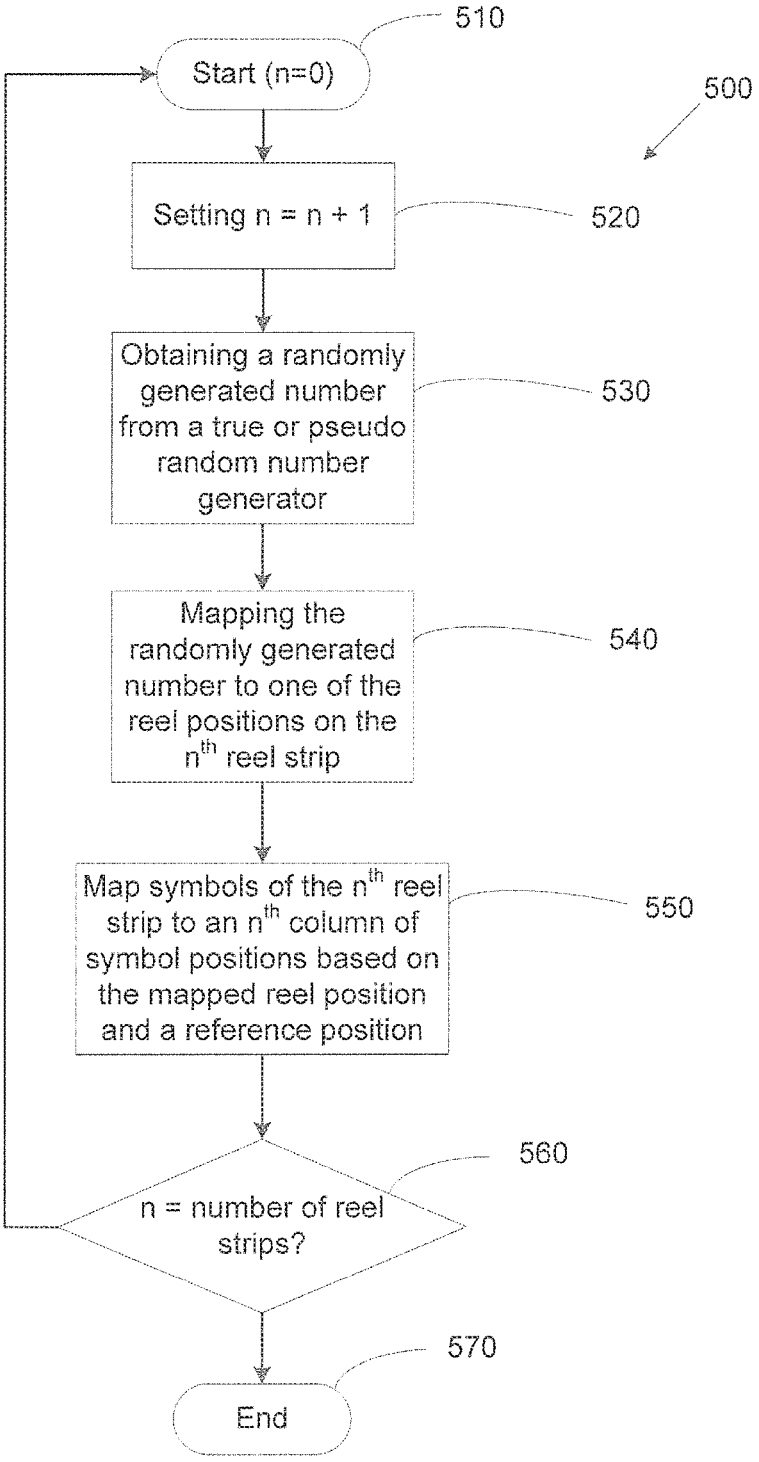
FIG. 5 is a flow chart of a symbol selection method.

FIG. 5 is a flow chart of a method 500 carried out by the processor 204 to select symbols from reel strips. At step 510, the processor 204 starts the process of selecting symbols with a counter (n) set at zero as symbols have not yet been selected from any reel strips. At step 520, the processor 204 increments the counter. In the first iteration, the counter is set to 1 to reflect that symbols are to be selected from a first reel strip. At step 530 the processor obtains a randomly generated number from a true or pseudo random number generator 212. At step 540 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up table. In one example, the ranges are each the same size so that each of the reel strip positions has the same chance of been selected. In other examples, the ranges may be arranged to weight the relative chances of selecting specific reel strip positions. The reel strips may be of different lengths.

At step 550, the processor 204 maps symbols of the $n^{th}$ reel strip to and $n^{th}$ column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighbouring reel strip positions are also mapped to the symbol positions of the column. Referring to the example reel strips of FIG. 4, if the value returned by the RNG 212 is mapped to reel position 413, then for the first reel strip 421, "Pic3" symbol 443 is mapped to a bottom symbol position, "10" symbol 442 is mapped to a middle symbol position, and "J" symbol is mapped to a top symbol position.

At step 560, the processor 560 determines whether symbols have been selected for all of the reel strips, and if not the processor reverts to step 520 and iterates through steps 530, 540 and 550 until it is determined at step 560 that symbols have been selected from all n reel strips and mapped to all n columns of symbol positions after which the symbol selection process ends 570. Different numbers of symbols may be mapped to different numbers of symbol positions.

After the symbols of all reel strips have been mapped to symbol position, the processor 204 controls display 240 to display them at the symbol positions.

An example embodiment will now be described with reference to FIGS. 6 and 7 of the drawings.

Figure 6:
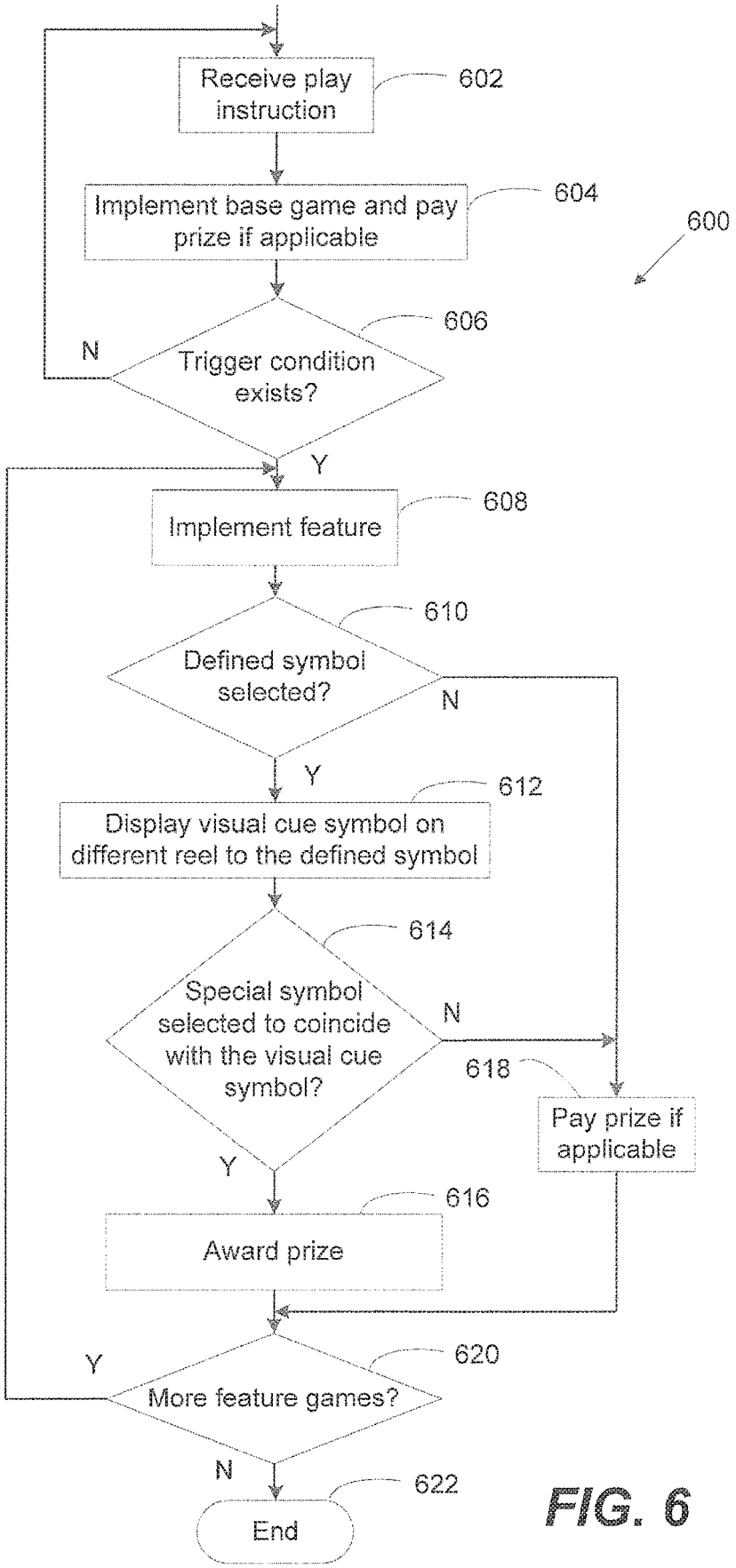
FIG. 6 is a flow chart illustrating an example game implementation.

FIG. 6 shows a flow chart 600 illustrating steps 602 to 622 of an example game implementation. In the illustrated example, on receipt of an initial game play instruction 602 from a player, a base game is implemented 604 that involves selection of symbols and display of the symbols in a display area. The selected and displayed symbols are used by the game controller 202 to determine a base game outcome and, if the base game outcome corresponds to a winning outcome, a prize is awarded to the player.

The game controller 202 makes a determination 606 during the base game as to whether the selected and displayed symbols correspond to a trigger condition. If no trigger condition exists, the player is able to provide a further play instruction 602 in order to commence a new base game. If a trigger condition exists, the game controller 202 implements 608 a feature game.

The trigger condition may be any suitable condition, for example selection and display of a defined combination of trigger symbols 436 during a base game.

Figure 7:
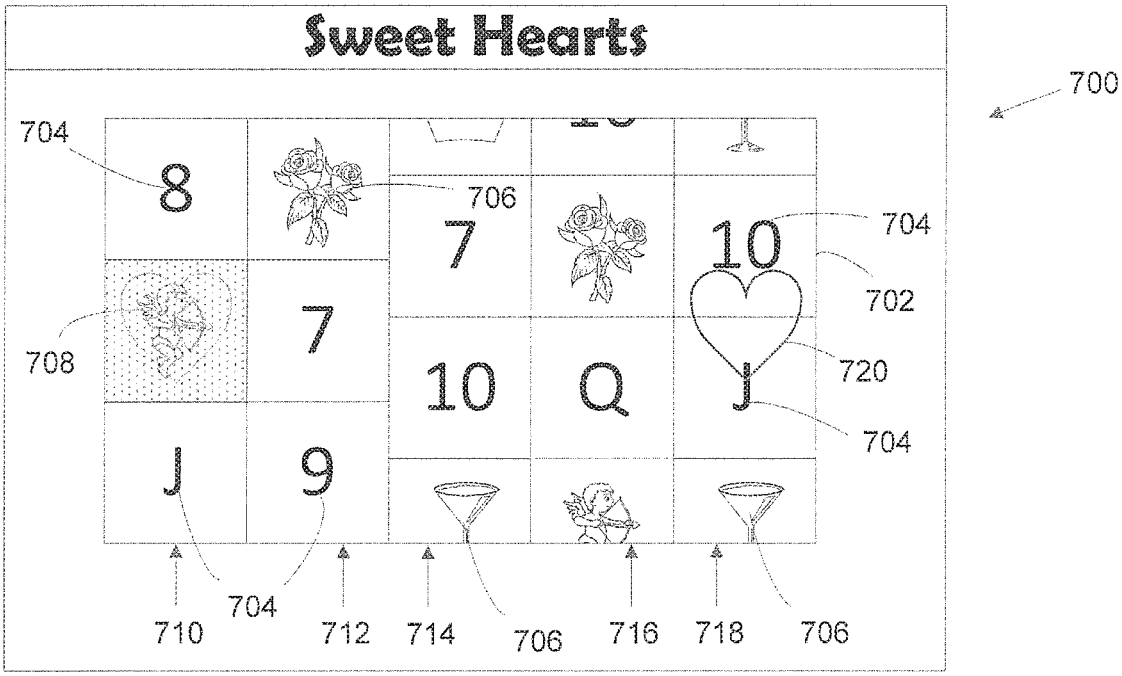
FIG. 7 illustrates an example screen displayed to a player during implementation of a jackpot feature and before determination of an outcome of the jackpot feature.

A representation 700 of a screen displayed to a player during a feature game is shown in FIG. 7.

In this example, the feature game is a jackpot feature, although it will be understood that other types of feature games are envisaged.

During the feature game, the game controller 202 selects symbols and causes the selected symbols to be displayed in a display area 702. The symbols available for the selection may be different to the symbols used during the base game or may be the same as the symbols used during the base game with additional functionality imparted to the symbols.

The feature screen 700 includes the symbol display area 702 in which a plurality of selected symbols are displayed. The symbols available for selection include standard symbols 704 and picture symbols 706 associated with a defined theme, in this example "sweet hearts".

The symbols also include at least one defined symbol 708, in this example a representation of the Roman God Cupid. When the defined symbol 708 is selected 610 and displayed during a feature game, in this example in a defined symbol group such as a first reel 710 of a plurality of reels 710, 712, 714, 716, 718 of a multi reel spinning reel type game, the defined symbol 708 in the first reel 710 is displayed with a modified appearance compared to other similar symbols in other reels and visual cue indicia 720 is displayed 612, in this example in a defined symbol group such as a fifth reel 718 of a multi reel spinning reel type game.

The system is arranged to progressively display the symbols selected in each display position group such that in this example selected symbols are displayed first in the first reel 710 and subsequently displayed in turn in the second, third, fourth and fifth reels 712, 714, 716, 718.

The visual cue indicia 720 is in the form of a special symbol frame 720 that is representative of the appearance of a special symbol in that a characteristic of the special symbol matches a characteristic of the visual cue indicia. In this example, the visual cue indicia is a symbol frame 720, wherein the special symbol fits within and is visible through the symbol frame 720 when the special symbol is displayed at the same location as the symbol frame 720.

Figure 8:
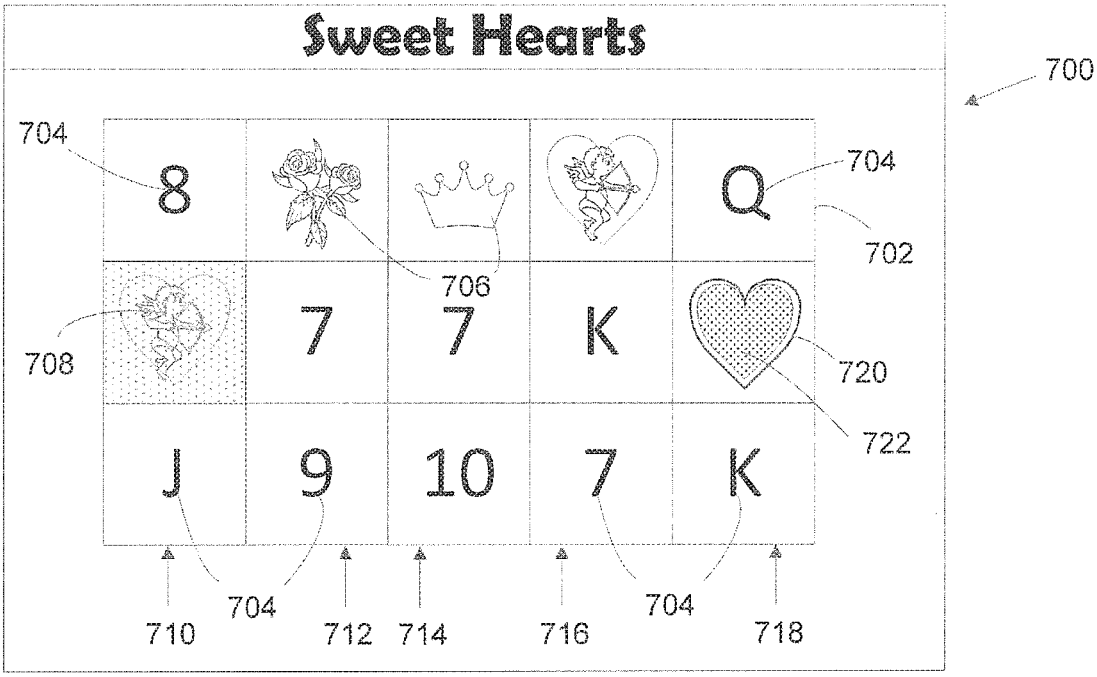
FIG. 8 illustrates an example screen displayed to a player during implementation of a jackpot feature and after determination of an outcome of the jackpot feature.

If the defined symbol 708 is selected and displayed in the first reel, the symbol frame 720 is displayed in a defined reel, such as the fifth reel 718, before the selected symbols are displayed in the fifth reel 718. In this example, the symbol frame 720 is stationary while the symbols in the fifth reel appear to rotate, as shown in FIG. 7. If after selection and display of symbols in the fifth reel 718, a special symbol 722 is displayed 614 at a display location that coincides with the symbol frame 720, as shown in FIG. 8, a jackpot is awarded 616 to the player. In this example, the visual cue 720 corresponds to the outline of a heart shape and the special symbol 722 is a heart symbol configured such that the shapes of the symbol frame 720 and the special symbol 722 are complimentary.

While in this example the visual cue indicia 720 is representative of the appearance of the special symbol in that an outline of the visual cue indicia matches the shape of the special symbol, other arrangements are possible. For example, the visual cue indicia 720 may representative of the appearance of the special symbol in that the visual cue indicia corresponds to a silhouette of the special symbol.

Figure 9:
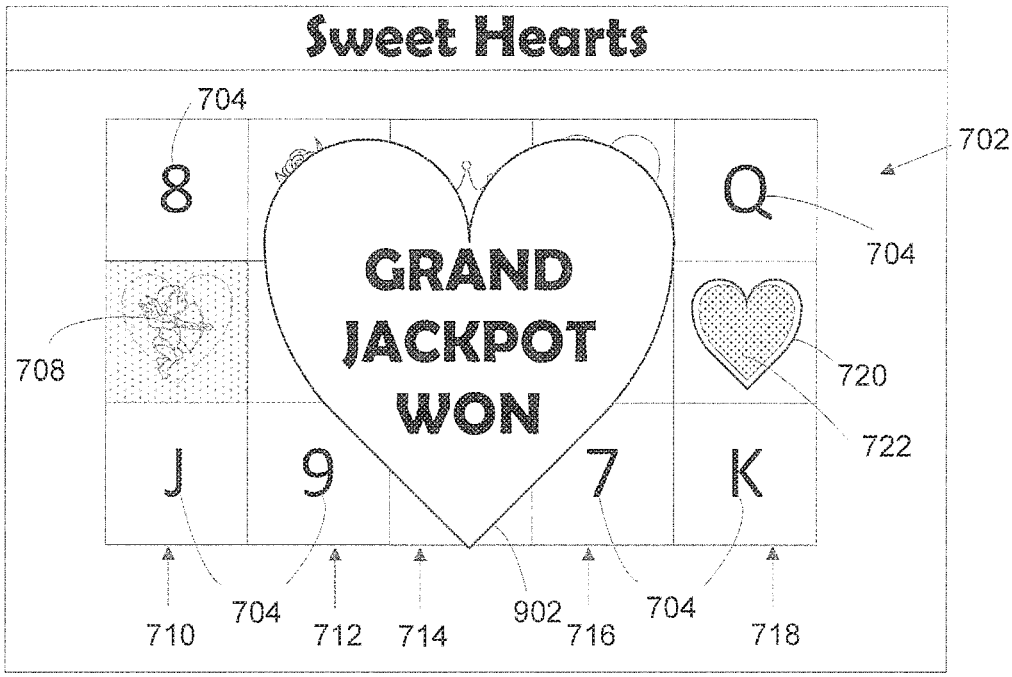
FIG. 9 illustrates an example screen displayed to a player when a jackpot has been won by the player.

In this example, if a jackpot is awarded, the system displays indicia to communicate to the player that a jackpot has been won, for example in the form of a symbol 902 that has the same shape as the special symbol frame 720 as shown in FIG. 9.

In this example, the jackpot prize amount may be the amount of or at least an amount derived from the amount of a Grand jackpot, may be the amount of or at least an amount derived from the amount of a Major jackpot, or may be the amount of or at least an amount derived from the amount of a Minor jackpot.

While the present embodiment is described in relation to a gaming system that implements a base game that does not display visual cue indicia and provide a prize when a special symbol is selected and displayed at the same location as the visual cue indicia, and a feature game that does display visual cue indicia and provide a prize when a special symbol is selected and displayed at the same location as the visual cue indicia, it will be understood that other arrangements are envisaged. For example, the gaming system may be arranged to implement one type of game that displays visual cue indicia and provides a prize when a special symbol is selected and displayed at the same location as the visual cue indicia, or to implement an arrangement wherein during both a base game and a feature game visual cue indicia is displayed and a prize provided when a special symbol is selected and displayed at the same location as the visual cue indicia.

In an embodiment, a gaming system comprises: a symbol selector that selects a defined number of symbols from a set of symbols for display in a symbol display area, the set of symbols including at least one special symbol; an outcome determiner that determines whether a winning outcome exists based on the displayed symbols; and a prize allocator that awards a prize if a winning outcome is determined to exist; wherein if a defined condition exists, the system displays visual cue indicia associated with a special symbol, the visual cue indicia displayed at a defined display location before a selected symbol is displayed at the defined display location, the visual cue indicia being representative of the special symbol; and wherein the system displays a succession of symbols at the defined display location before displaying a selected symbol at the defined display location; the outcome determiner determining that a winning outcome exists if a special symbol is selected and displayed at the defined display location.

In an embodiment, the feature game is a jackpot feature having an accumulating prize pool.

The jackpot feature may include multiple accumulating prize pools arranged to accumulate such that the respective prize pools have different prize amounts.

In an embodiment, the prize allocator is arranged to award at least one free game when a winning outcome is determined to exist.

In an embodiment, the prize allocator is arranged to award at least one game related bonus when a winning outcome is determined to exist.

In an embodiment, the defined condition comprises display of at least one defined symbol.

The defined condition may comprise display of at least one defined symbol in a defined display position group. The gaming system may comprise a plurality of reels, each reel including symbols of the set of symbols, and the defined condition may comprise display of at least one defined symbol in a defined reel, such as a first reel.

In an embodiment, the visual cue indicia includes an outline that corresponds to the shape of the special symbol. The visual cue indicia may define a frame such that the special symbol fits within and is visible through the frame when the special symbol is displayed at the defined display location.

In an alternate embodiment, the visual cue indicia comprises a silhouette of the special symbol.

The defined display location may be in a defined display position group, which may be in a defined reel such as a fifth reel.

In an embodiment, the system is arranged to implement a base game, and to implement a feature game when a trigger condition is determined to exist in the base game, wherein during the feature game: the system displays visual cue indicia associated with a special symbol if a defined condition exists; prior to displaying the selected symbols, the system displays a succession of symbols at the defined display location and subsequently displays a selected symbol at the defined display location; and if a special symbol is selected and displayed at the defined display location, the outcome determiner determines that a winning outcome exists.

In a further embodiment, a method of gaming comprises: selecting a defined number of symbols from a set of symbols for display in a symbol display area, the set of symbols including at least one special symbol; if a defined condition exists, displaying visual cue indicia associated with a special symbol, the visual cue indicia displayed at a defined display location before a selected symbol is displayed at the defined display location, the visual cue symbol and the visual cue indicia being representative of the appearance of the special symbol; displaying a succession of symbols at the defined display location before displaying a selected symbol at the defined display location; determining that a winning outcome exists if a special symbol is selected and displayed at the defined display location; and awarding a prize if a winning outcome is determined to exist.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

It is to be understood that, if any prior art is referred to herein, such reference does not constitute an admission that the prior art forms a part of the common general knowledge in the art in any country.

In the claims which follow and in the preceding description of the disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

The invention claimed is:

1. An electronic gaming system comprising:

a display including a symbol display area;

an input operable to receive a credit and establish a credit balance;

a player interface operable to be actuated in response to the input receiving the credit and having established the credit balance; and a game controller comprising a processor and a memory, the memory storing a) a set of symbols including a special symbol, and b) instructions, which, when executed, cause the processor to at least:

receive at the player interface an actuation to initiate a game instance, randomly select a first subset of symbols from the set of symbols by a random number generator based on one or more random outcomes generated from the random number generator, display the first subset of symbols selected in the symbol display area, display, in response to the first subset of symbols selected including a defined symbol, at a defined display location, a visual cue indicium at a defined display location, randomly select a second subset of symbols based on one or more random outcomes, display at the symbol display area the second subset of symbols while stationing the visual cue indicium at the defined display location, determine if the second subset of symbols selected includes the special symbol at the defined display location that coincides with the visual cue indicium stationed at the defined display location, and display an award if the special symbol displayed at the defined display location coincides with the visual cue indicium stationed at the defined display location.

2. The electronic gaming system of claim 1, wherein the visual cue indicium stationed comprises a characteristic of the special symbol, the characteristic includes an outline that corresponds to a shape of the special symbol.

3. The electronic gaming system of claim 2, wherein the visual cue indicium stationed defines a frame that fits the special symbol within the frame and is visible through the frame when the special symbol is displayed at the defined display location.

4. The electronic gaming system of claim 1, wherein the visual cue indicium stationed comprises a silhouette of the special symbol.

5. The electronic gaming system of claim 1, wherein the symbol display area comprises a plurality of reels associated with a plurality of respective display position groups, and wherein one of the plurality of respective display position groups includes a defined display position group that comprises a defined reel, and a defined condition comprises the defined symbol being displayed on the defined reel.

6. The electronic gaming system of claim 5, wherein the plurality of reels form a set of five reels, and wherein the defined reel is a first reel of the set of five reels.

7. The electronic gaming system of claim 1, wherein the symbol display area comprises a set of five reels, and wherein the defined display location is in a defined display position group is a defined reel of is a first reel of the set of five reels.

8. A non-transitory computer-readable medium for conducting a game on a gaming machine that comprising a display device including a symbol display area, an input operable to receive a credit and establish a credit balance, a player interface operable to be actuated in response to the input receiving the credit and having established the credit balance, and a server comprising a processor and a memory storing a) a set of symbols including a special symbol, and b) instructions, which, when executed by the processor, cause the processor to perform at least the following:

controlling the processor to receive at the player interface an actuation to initiate a base game;

controlling the processor to initiate a feature game when a trigger condition is determined to exist in the base game;

in the feature game:

randomly selecting a first subset set of symbols from the set of symbols by a random number generator based on one or more random outcomes generated from the random number generator;

in response to first subset of symbols selected including a defined symbol, displaying a visual cue indicium at a defined display location;

selecting a second subset of symbols from the set of symbols based on one or more random outcomes;

displaying at the symbol display area the second subset of symbols while stationing the visual cue indicium at the defined display location;

determining if the second subset of symbols selected includes the special symbol at the defined display location that coincides with the visual cue indicium stationed at the defined display location;

determining that a winning outcome exists if the special symbol displayed at the defined display location coincides with the visual cue indicium stationed at the defined display location; and displaying an award if the winning outcome exists.

9. The non-transitory computer-readable medium of claim 8, wherein the feature game is a jackpot feature having an accumulating prize pool.

10. The non-transitory computer-readable medium of claim 9, wherein the jackpot feature further includes multiple accumulating prize pools arranged to accumulate such that respective prize pools have different prize amounts.

11. The non-transitory computer-readable medium of claim 8, wherein the visual cue indicium stationed comprises a characteristic of the special symbol, the characteristic includes an outline that corresponds to a shape of the special symbol.

12. The non-transitory computer-readable medium of claim 11, wherein the visual cue indicium stationed defines a frame such that the special symbol fits within and is visible through the frame when the special symbol is displayed at the defined display location.

13. The non-transitory computer-readable medium of claim 8, wherein the visual cue indicium stationed comprises a silhouette of the special symbol.

14. A method of arranging a visual cue indicium with a special symbol characteristic on a gaming machine comprising a display device including a symbol display area, an input operable to receive a credit and establish a credit balance, a player interface operable to be actuated in response to the input receiving the credit and having established the credit balance, and a game controller comprising a processor and a memory, the memory storing a) a set of symbols including a special symbol, and b) instructions, which, when executed, cause the processor to initiate a feature game, the method comprising:

receiving at the player interface an actuation of a selection to initiate a game instance;

displaying, in a first succession, a first subset of symbols in the symbol display area, wherein the first subset of symbols is randomly selected from the set of symbols based on one or more random outcomes generated from a random number generator;

in response to a defined symbol being randomly selected and displayed in the symbol display area, displaying, at a defined display location, a visual cue indicium representative of an appearance of the special symbol;

displaying, in a second succession, a second subset of symbols randomly selected from the set of symbols in the symbol display area while stationing the visual cue indicium at the defined display location; and displaying an award if the second subset of symbols selected includes the special symbol at the defined display location that coincides with the visual cue indicium stationed at the defined display location.

15. The method of arranging the visual cue indicium of claim 14, wherein the visual cue indicium stationed comprises a characteristic of the special symbol, the characteristic includes an outline that corresponds to a shape of the special symbol.

16. The method of arranging the visual cue indicium of claim 15, wherein the visual cue indicium stationed defines a frame such that the special symbol fits within and is visible through the frame when the special symbol is displayed at the defined display location.

17. The method of arranging the visual cue indicium of claim 14, wherein the visual cue indicium stationed comprises a silhouette of the special symbol.

18. The method of arranging the visual cue indicium of claim 14, wherein the symbol display area comprises a plurality of reels associated with a plurality of respective display position groups, and wherein one of the plurality of respective display position groups includes a defined display position group that comprises a defined reel, and a defined condition comprises the defined symbol being displayed on the defined reel.

19. The method of arranging the visual cue indicium of claim 14, wherein the symbol display area comprises a set of five reels, and wherein the defined display location is in a defined display position group is a defined reel of the set of five reels.

20. The method of arranging the visual cue indicium of claim 19, wherein the visual cue indicium stationed is stationary while a number of symbols selected are displayed as rotating.

* * * * *